US011722831B2

(12) United States Patent
Kron

(10) Patent No.: US 11,722,831 B2
(45) **Date of Patent: *Aug. 8, 2023**

(54) METHOD FOR AUDIO REPRODUCTION IN A MULTI-CHANNEL SOUND SYSTEM

(71) Applicant: KRONOTON GMBH, Reinbek (DE)

(72) Inventor: Gunnar Kron, Aumuelhe (DE)

(73) Assignee: Kronoton GmbH, Reinbek (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/470,439

(22) Filed: Sep. 9, 2021

(65) Prior Publication Data

US 2022/0070602 A1 Mar. 3, 2022

Related U.S. Application Data

(63) Continuation of application No. 15/109,676, filed as application No. PCT/EP2014/003477 on Jan. 2, 2015, now Pat. No. 11,153,702.

(30) Foreign Application Priority Data

Jan. 5, 2014 (DE) ..... 10 2014 100 049.8

(51) Int. Cl.
*H04S 5/00* (2006.01)
*H04S 5/02* (2006.01)
*G10L 19/008* (2013.01)

(52) U.S. Cl.
CPC ..... *H04S 5/005* (2013.01); *G10L 19/008* (2013.01); *H04S 5/02* (2013.01); *H04R 2201/401* (2013.01); *H04R 2499/15* (2013.01); *H04S 2400/01* (2013.01)

(58) Field of Classification Search
None
See application file for complete search history.

(56) References Cited

U.S. PATENT DOCUMENTS

| | | | | |
|---|---|---|---|---|
| 6,122,382 | A * | 9/2000 | Iida | H04S 3/00 381/17 |
| 2004/0125967 | A1* | 7/2004 | Eid | H04S 3/02 381/98 |
| 2009/0060237 | A1* | 3/2009 | Konagai | H04R 3/12 381/307 |
| 2010/0303246 | A1* | 12/2010 | Walsh | H04S 3/00 381/18 |
| 2013/0208895 | A1* | 8/2013 | Horbach | H04S 5/005 381/17 |

* cited by examiner

*Primary Examiner* — Duc Nguyen
*Assistant Examiner* — Assad Mohammed
(74) *Attorney, Agent, or Firm* — WCF IP

(57) ABSTRACT

The invention relates to a method for reproducing audio in a multi-channel sound system including two input signals (L and R), wherein output signals are generated for different sound perception levels. In order to develop said method in such a way that audio can be reproduced within a larger range of applications in a multi-channel sound system, according to the invention, only a lower sound perception level (7) and a higher sound perception level (6) are generated, and a maximum of six output signals are generated, a maximum of two output signals being allocated to the lower sound perception level (7) and a maximum of four output signals being allocated to the higher sound perception level (6).

11 Claims, 12 Drawing Sheets

METHOD FOR AUDIO REPRODUCTION IN A MULTI-CHANNEL SOUND SYSTEM

Figure 1:
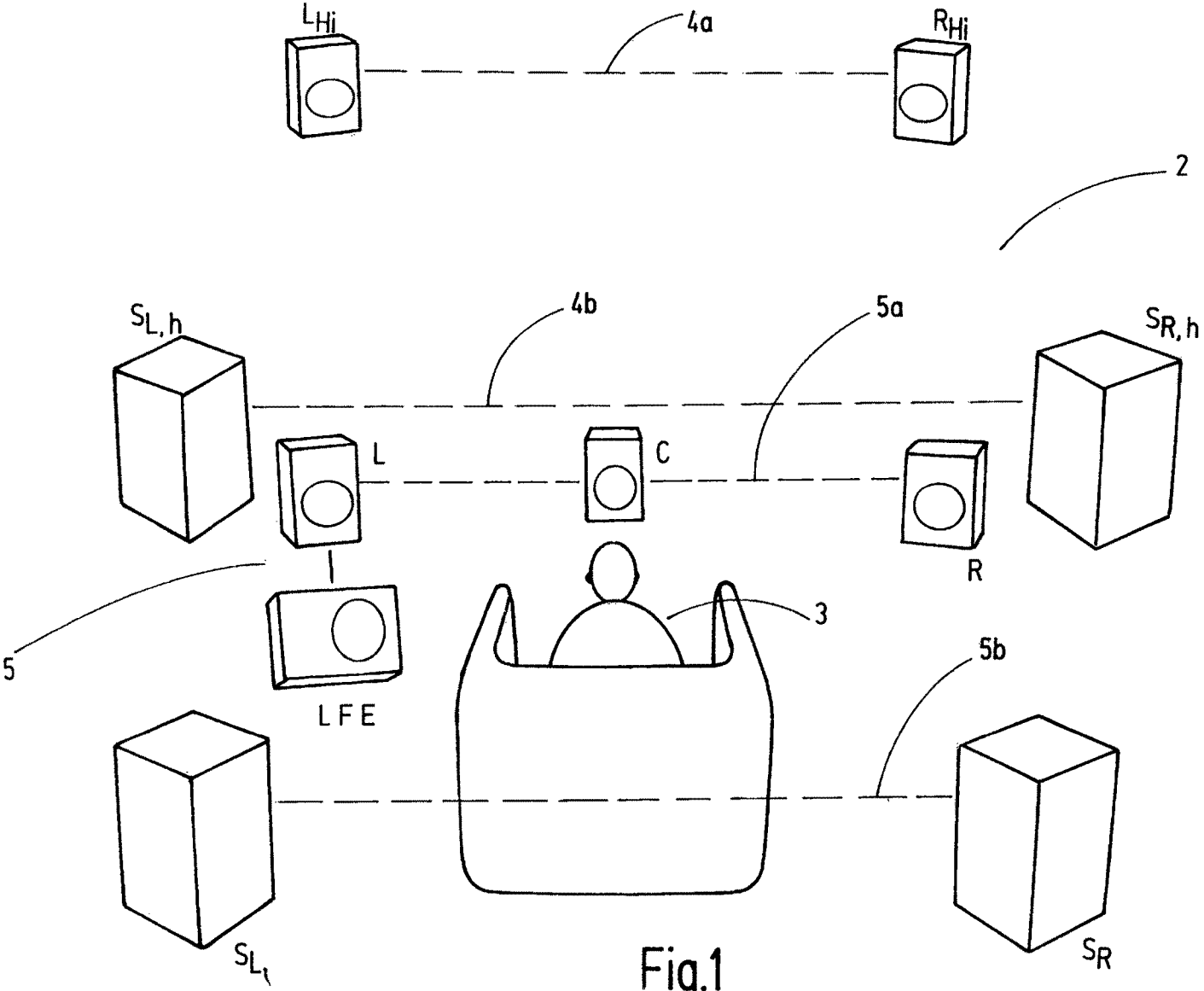

The invention relates to a method for reproducing audio in a multi-channel sound system comprising two input signals L and R, wherein output signals are generated for different listening levels.

Methods of the above-mentioned type are known to those skilled in the art and represent a further development of a conventional surround sound system, an audio reproduction, which takes place only at the ear level, that is, at the lower listening level.

For the three-dimensional audio reproduction in a multi-channel sound system, a higher listening level is added to the lower listening level. Herein also lies the decisive advantage of the method of the above-named type, since the human ear can perceive and differentiate upwardly staggered sounds clearly, so that the listener, due to the three-dimensional loudspeaker arrangements, enjoys the pleasure of an expanded sound experience. Methods of the above-named type have been developed mainly for audio signals in large rooms, such as cinema auditoriums.

In the prior art, different views are represented as to which speaker configurations or type of generating the three-dimensional sound, whether channel-based or object-based, lead to an optimum audio experience, wherein either the multichannel recording and reproduction of a three-dimensional audio space, as described in WO 01/47319 A2, or the upmix of variable input channels to a three-dimensional audio room offered by various providers are in the foreground of consideration. The three-dimensional audio systems of Dolby Laboratories, for example, have up to 64 loudspeakers (such as Dolby Atmos), which, in turn, require a corresponding number of output signals.

It is a common feature of all the methods named above that a complex loudspeaker configuration and, accordingly, a correspondingly larger number of output signals are required in order to generate the desired three-dimensional sound space.

Even a loudspeaker configuration in a 9.1 three-dimensional sound system, which is suitable, for example, for a home cinema, consists of 10 loudspeakers, which, in turn, require a corresponding number of output signals for the lower and upper listening levels.

In accordance with the present prior art, it is possible only with difficulty for consumers, who are used to AV equipment (audio video equipment), to have the enjoyment of the advantages of three-dimensional audio reproduction, since it is reserved for only a few to acquire the costly equipment with a three-dimensional audio reproduction and only a limited number of consumers have suitable rooms, in which it is possible to accommodate a larger number of loudspeakers with their cables. The reality therefore is that, admittedly, cinemas, music studios or also selected concert halls have the technical equipment for three-dimensional audio reproduction, but that this does not enter into the everyday life of those who would like to have the advantages of three-dimensional audio reproduction in a simple and uncomplicated manner, with a few, easy steps and with, comparatively, a low budget, for example, at the workplace or in the living room or while traveling.

It is therefore an object of the invention to develop a method of the above-mentioned type, so that these disadvantages are eliminated.

This object is solved by the features of claim 1. Advantageous configurations of the invention are described in the dependent claims.

The invention provides that only one lower listening level and only one upper listening level are generated, wherein a maximum of six output signals are generated with no more than two output signals for the lower listening level and no more than four output signals for the upper listening level.

The core idea of the invention is to make a method available, which, by generating the least possible number of output signals, can reflect a three-dimensional audio reproduction and cover the mono region as well as the stereo region.

This results in the smallest unit, which, advantageously, can be expanded in modular fashion in that the output signals serve as further input signals, in order to generate further lower and upper listening levels and, accordingly, an even more complex loudspeaker configuration.

By means of the method according to the invention and the software corresponding thereto, it is possible, for example, to realize the increased sound level by adding two small loudspeakers to domestic television sets or to laptops.

In an advantageous configuration of the invention, channels are decoded for the input channels provided for the input signals R and L. These channels preferably are a left spatial channel $R_L$=L−R, a right spatial channel $R_R$=R−L and a center channel C=L+R. Advisably, linear and parallel channels R and L, which preferably serve as output channels for the lower listening level, are generated to these decoded channels from the input channels. Practical variations of the invention generate stereo signals or respectively mono signals for the signals in the lower and upper listening level.

A device with sound input and sound output channels, as well as with a processor, loudspeakers being assigned to the processor, is the subject matter of claim 10, wherein a software is ported onto the processor and contains an algorithm, which is processed by the processor, the algorithm covering the method of one of the claims 1 to 9.

A software, which is on a signal processor, that is, ported onto the signal processor, is also provided within the scope of the invention. The software contains an algorithm, which is processed by the signal processor, the algorithm covering the method.

Figure 9:
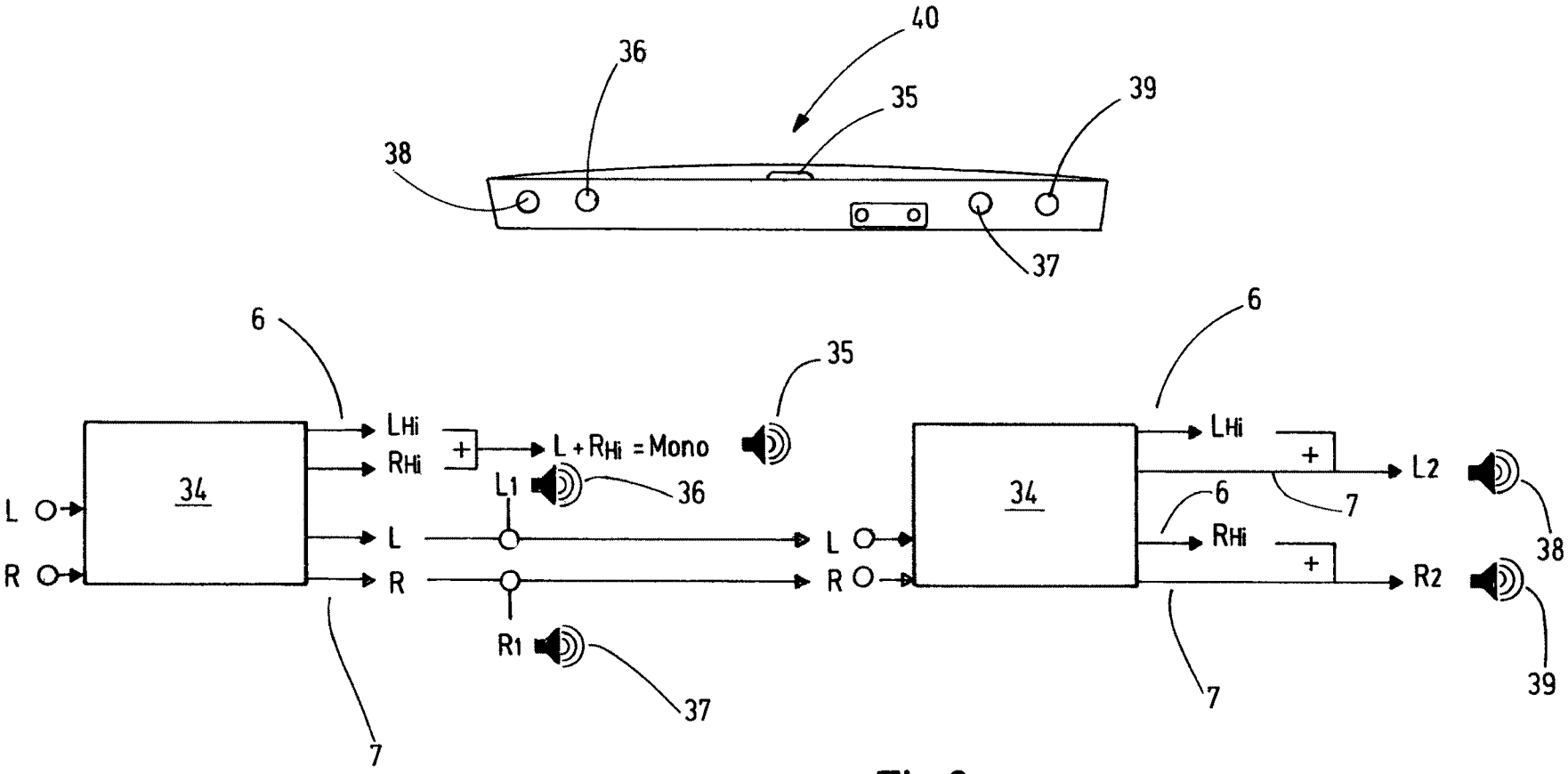
Figure 10:
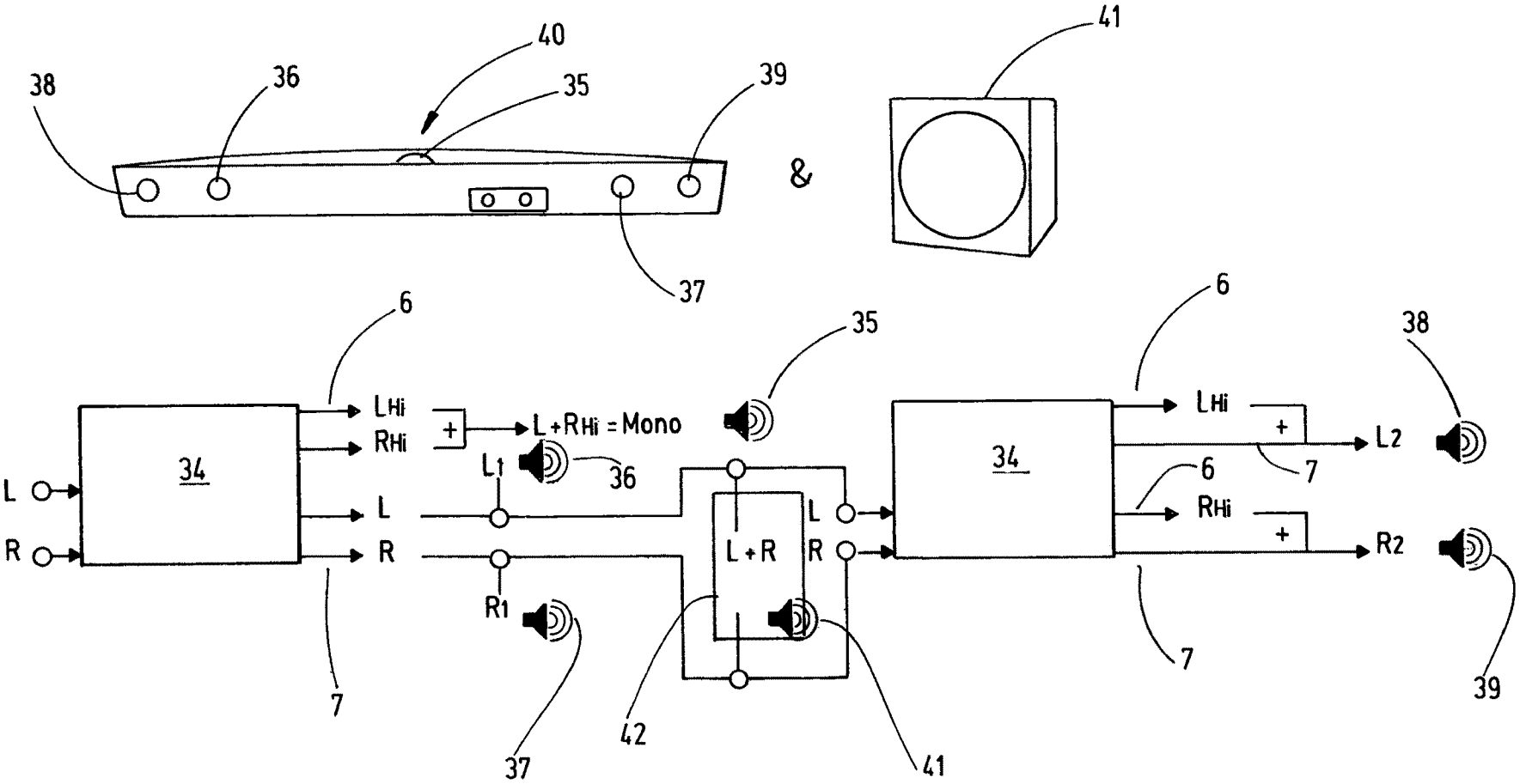
Figure 11:
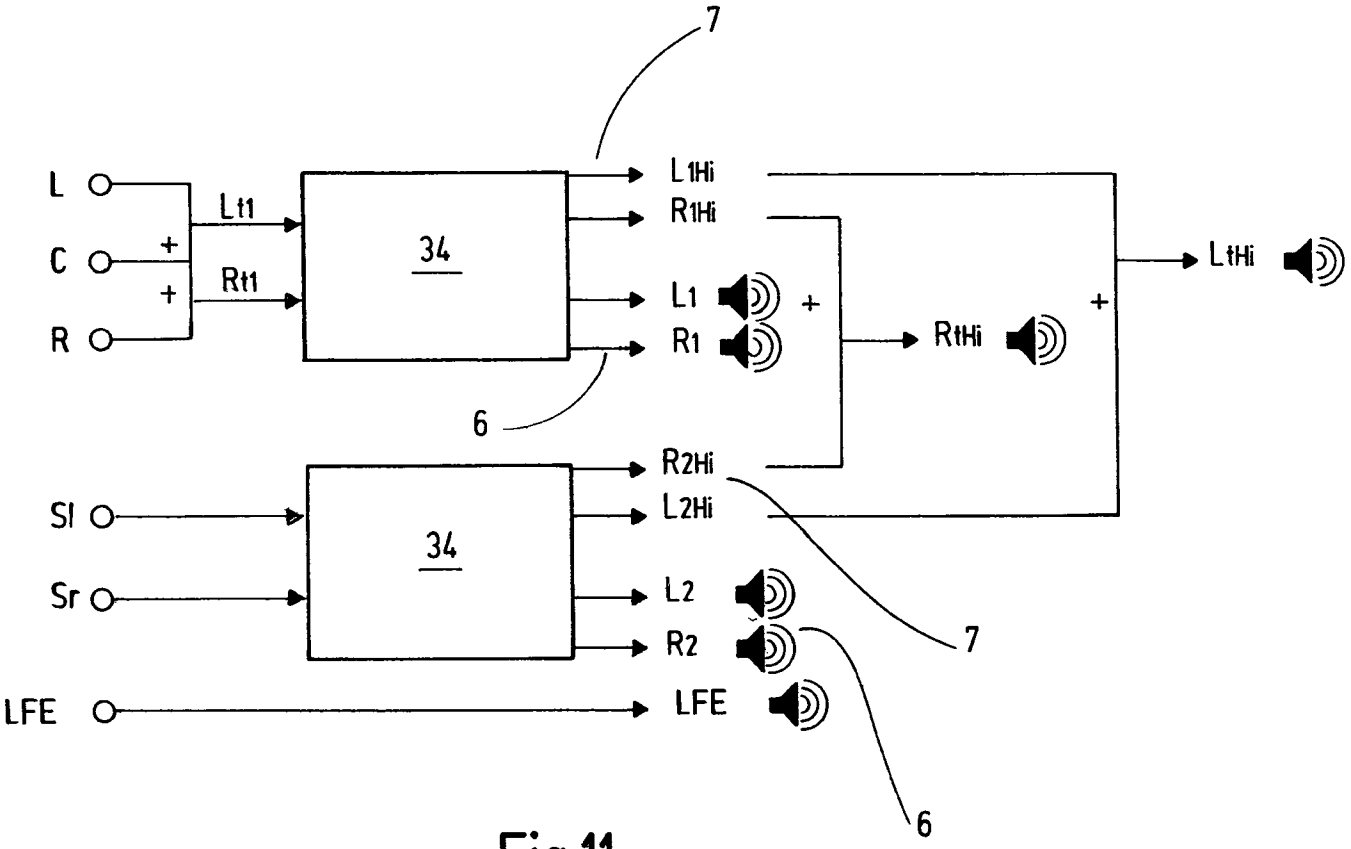
Figure 12:
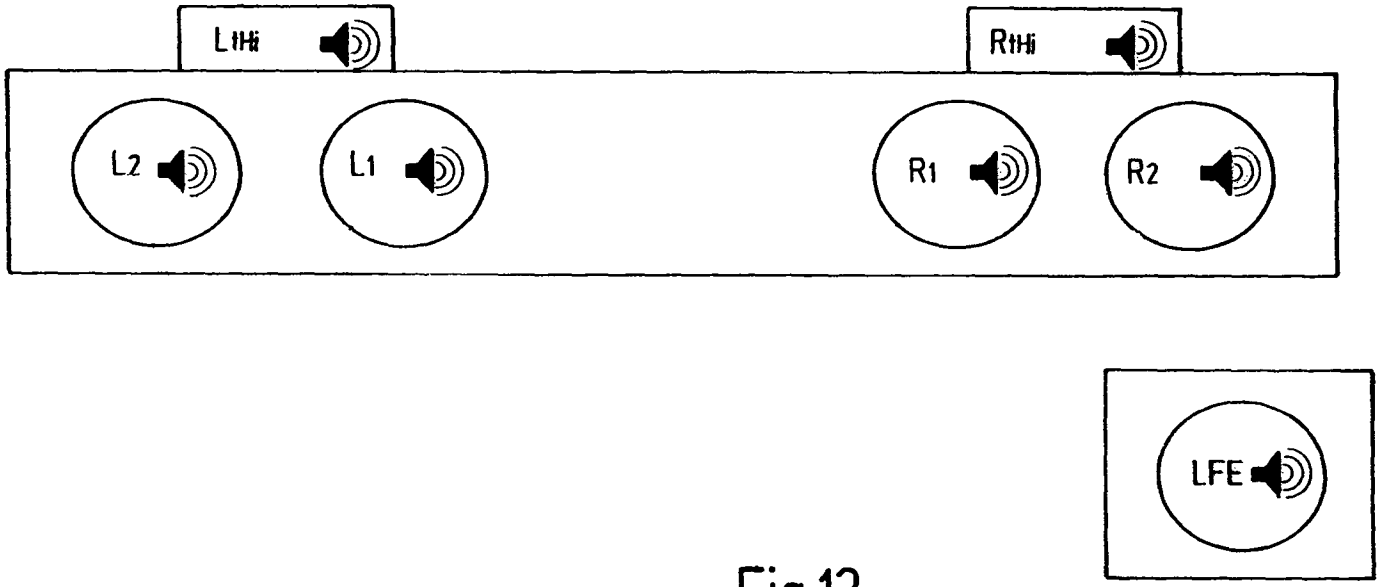

In the following, the invention is explained in greater detail by means of the drawings. In diagrammatic representation, FIG. 1 shows a loudspeaker arrangement of a 3D sound format with different listening levels of the prior art, FIG. 2 shows a method of the invention, FIGS. 3A-B, 4A-B, 5A-B, 6A-B, 7A-B, and 8A-B show different embodiments of AN equipment, into which a method of FIG. 2 is integrated, FIGS. 9 to 11 show further embodiments of the method according to the invention and FIG. 12 shows a device into which the method according to the invention of the embodiment of FIG. 11 is integrated.

Figure 2:
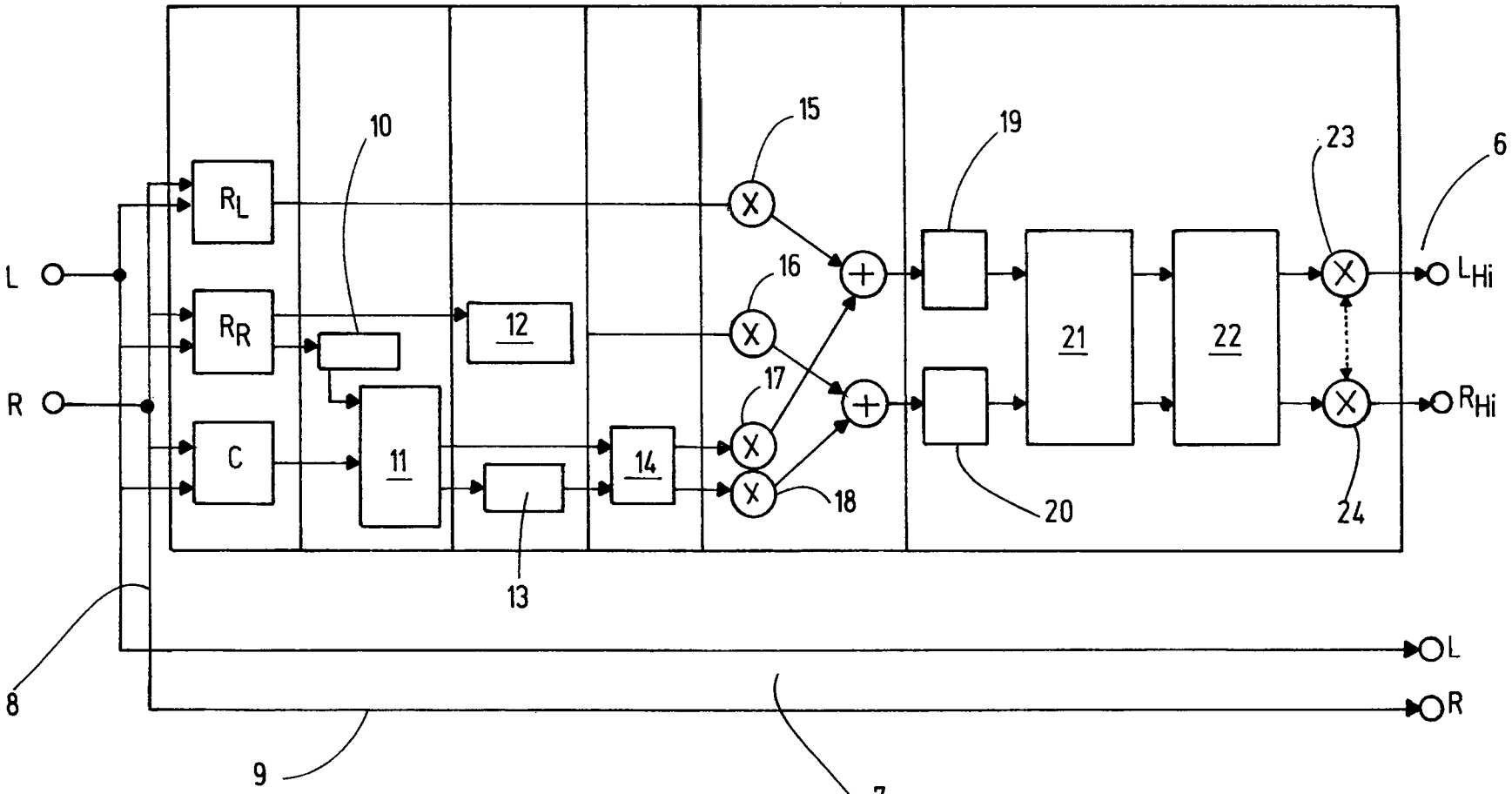

FIG. 1 shows a conventional, three-dimensional audio reproduction system in a larger room 2, which is occupied by a listener 3, within the scope of a 9.1 surround-sound format. In the room 2, several loudspeakers of a loudspeaker arrangement 5, to which lower as well as higher listening levels 4*a*, 4*b*, 5*a*, 5*b* are assigned, are distributed.

The upper listening level 4*a*, with two loudspeakers with the left higher signal $L_{Hi}$ and the right higher signal $R_{Hi}$ as output signals, are in the front area of the room 2. Furthermore, the lower listening level 5*a* with four loudspeakers with the left signal L, the channel C (Center), the right channel R and the LFE (low frequency effect) channel as output signals, are in the front area of the room 2. The upper listening level 4*b* with two loudspeakers with the left, higher surround signal $S_{L,hi}$ and the right, higher surround signal $S_{R,hi}$ as output signals, are in the rear region of the room 2. The lower listening level 5*b* with two loudspeakers with the two surround signals $S_L$, $S_R$ as output signals is in the front region of the room 2.

Before the signals are distributed in the lower and upper listening levels 4*a*, 4*b*, 5*a*, 5*b* to the loudspeakers, they are processed within the scope of a multichannel sound system and, starting out from the input signals R and L, by an audio processor intended for this purpose.

FIG. 2 shows the method according to the invention, which, starting out from the two input channels R and L, generates, over linear and parallel channels 8, 9, the output signals R and L in the lower listening level 7 and the left output signal $L_{Hi}$ and the right output signal $R_{Hi}$ n the upper listening level 6, so that four output signals, two for the upper and two for the lower listening level, are generated. A signal processor in the form of an audio processor, on which there is a software, serves for carrying out the method. The software contains an algorithm, which is processed by the signal processor, the algorithm covering the method.

As furthermore shown in FIG. 2, the upper listening level 6 passes through further steps of the method, starting out from the two input signals L and R.

In particular, the method sections are a decoding, a signal control, a phase correction, a frequency adjustment, an encoding, a master section.

To begin with, three channels are decoded from the two output signals L and R and formed parallel next to the channels 8, 9, which are guided linearly to the output. The upper listening level 6 arises by these means, while the channels 8, 9, which are guided linearly to the output, form the lower listening level 7.

The decoded channels are the left spatial channel $R_L$=L−R, the right spatial channel $R_R$=L−R and the center channel L+R.

The channels $R_L$ and R, illustrate the premises and reflections within the input signals L, R, whereas the channel C (center channel) depicts the addition of both input channels L, R. By these means, it is possible to process the input signals L, R further, when it is a question of a mono signal. If there is a mono signal at the input, the channels $R_L$ and R, remain mute and the channel C passes on the signal information and thus makes the further signal processing possible.

After this encoding step, the channel R, is passed into the signal detector 10. The latter issues the control signal "1", when the signal strength of R, falls below the threshold level selected, and the control signal "0", when the level of the channel R, rises above the selected threshold level. The threshold level is −20 dB and the reaction time (trigger) zero seconds.

The control signals of the signal detector 10 are multiplied by the signal multiplier 11 with the signal of the center channel. If no recognized signal is present in the channel $R_R$, so that there is no stereo signal in the channels $R_L$ and $R_R$ above or equal to the signal strength specified by the threshold level and the signal detector 10 generates the control signal "1", the channel C is multiplied by "1" and supplied to a further processing. If a recognized signal is present in the channel $R_R$, so that a stereo signal is in the channels $R_L$ and $R_R$ above or equal to the signal strength specified by the threshold level and the signal detector 10 generates the control signal "0", the channel C is multiplied by "0" and not released for further processing, since the signal is equal to zero, so that it is recognized unequivocally whether a stereo signal is present.

In order to avoid a phase shift of the channels $R_L$, $R_R$, a phase correction is made in a next step of the method, as furthermore shown clearly in FIG. 2, in order to transform the signal from the channels $R_L$ and $R_R$ into a stereo signal free from phase shift. This is achieved by the use of a delay 12 in the channel $R_R$. The channel $R_R$ is delayed with respect to the channel $R_L$ so that the phases of the two channels are placed into a not phase-shifted audio signal in stereo. The delay time is 140 samples at a frequency of 48 kHz and 16 bit.

In order to intensify the later impression of a reflection for the upper listening level 6, the phase of the channel C is also adjusted and, moreover, by a delay 13, which is used on the channel $C_R$, after the channel C (L+R) has been split into the channels $C_L$ and $C_R$ after the signal multiplier 11 and continued in this fashion in dual mono channels. The channel C is strictly a mono channel and can be converted into a stereo signal by splitting into the two duo mono channels $C_L$ and $C_R$ and the retardation of the channel $C_R$ to the channel $C_L$ by a delay and, moreover, with a phase correlation above 0. By these means, the audio impression of an increased diffusivity of the original signal results and contributes to the impression of the tonal range of heightened hearing, since a mono signal, which was recorded with microphones installed in an elevated position, is reproduced also not linearly but diffusely and afflicted with reflections, depending on the nature of the recording room and the height of the installed microphones.

Within the scope of a further step of the method, the frequency of the center channel C is adjusted by means of the equalizer 14. The frequency adjustment of channel C adjusts the frequency-dependent reproduction of the latter in the later output signals $L_{Hi}$, $R_{Hi}$ of the upper perception level 6 and, moreover independently of the later frequency adjustment of the output signal. By these means, the sound character of the output signals $L_{Hi}$, $R_{Hi}$ can be adjusted optimally to the AV equipment shown in FIGS. 3 to 8, over which these two channels can be emitted. The encoding, as a further step of the method, sums up the stereo signal of the channels $R_L$, $R_R$ and the stereo signal of the channels $C_L$, $C_R$ to the channels $L_t$, $R_t$ in such a manner, that the channels RL and $C_L$ form the channel Lt and the channels $C_R$ and $R_R$ form the channel $R_t$. The summing up is accompanied by a level adjustment at the level controls 15, 16, 17, 18, since the levels of the newly created channels $L_t$, $R_t$ are raised by the described summing up of the channels $R_L$, $R_R$ and $C_L$, $C_R$. The level adjustment lowers the levels $R_L$, $R_R$, $C_L$, $C_R$ correspondingly, so that their summing up cannot lead to overloading. Due to the encoding, there is now a stereo signal, which can be processed by the subsequent master section and also played back by conventional commercial audio playback components. Alternatively, it is also possible to generate two independent stereo signals, in that the channels $R_L$, $R_R$, and $C_L$, $C_R$, are not encoded, so that four output signals arise in the upper listening level 6.

In order to intensify the auditory impression of a "sound reflection upward", the signals $L_t$ and $R_t$, as is furthermore evident from FIG. 2, are adjusted over the equalizers 19, 20 within the scope of the master section, individually to their later use in their frequency responses. Depending on the desired radiation characteristics, the signals $L_t$ and $R_t$ appear to be further removed from the original source of sound. The effect of the sound emission can also be imitated here by a frequency response. The further removed it appears to be from the source of sound upwards, the more can, for example, the upper frequencies be lowered by a low-pass filter. By adjusting the frequency, it is also possible to match this sound result optimally to the loudspeaker or loudspeakers, which radiates or radiate the output signals $L_{Hi}$, $R_{Hi}$, later on.

By using an echo and/or a stereo delay 21, which are mixed with the signal $L_t$, $R_t$ in a ratio which can be adjusted individually and according to the type of use of the method, a room as well as a sound delay is portrayed. By these means, it is ensured that the output signals $L_{Hi}$, $R_{Hi}$ of the upper listening level 6 can also portray various rooms and sound delays through the use of different presets, which can be saved, in order to be able to match the sound result even more closely to a true "sound reflection upwards" as well as to the individual sound conceptions of the manufacturer and/or the user.

In order to intensify the hearing sensation that the output signals $L_{Hi}$, $R_{Hi}$ reproduce sound "which comes up from below" even further, a compression step is inserted into the master section, as shown in FIG. 2. Adjusting the compressor 22 or a limiter ensures that the signal is smoothed, so that the sound peaks are intercepted and the quieter parts of the audio signal $R_{t,Hi}$, $R_{t,Hi}$ are raised. This enhances the audio impression of the diffuse and remote sound, since sound peaks preferably occur in the vicinity of a sound source and decrease as the recording microphone is moved away upwards from there. Moreover, by means of the compression it is possible to adjust the ratio of the dynamic response to the channels L, R in the lower listening level 7.

The level adjustment of the channels $L_{t,Hi}$, $R_{t,Hi}$ at the level adjusters 23, 24 is a further step of the method, in that the output level is adjusted in relation to channels of the lower listening level 7, so that the impression of heightened hearing can be matched perfectly to the respective hearing situation. Alternatively, it is also possible to mix the audio signal $L_{t,Hi}$, $R_{t,Hi}$ once again with the channels L, R, in order to be able to portray an enhanced sound impression also in loudspeaker systems with only two loudspeakers or even only one.

The following parameters come into consideration for the individual steps of the method.

Phase correction:

Delay time: 140 samples at a frequency of 48 kHz, 16 bit

Channel C phase adjustment

Delay time: 10 samples at a frequency of 48 kHz, 16 bit

Channel C frequency adjustment:

High pass filter: limit frequency at 200 Hz, gain=0, Q factor equals 1.41

Low pass filter: limit frequency at 3000 Hz, gain=0, Q factor=1.41

Encoding:

The levels are adjusted so that the encoded summing up of the channels RL, RR, CL, CR has the same level (dB) as that of RL, RR before the summing up.

Master Section/Frequency Adjustment:

High pass filter: limit frequency at 200 Hz, gain=0, Q factor=1.41

Low pass filter: limit frequency at 3000 Hz, gain=0, Q factor=1.41

Master Section/Room/Reflection

Individually adjustable, no ideal settings, depends on the method used. Advantageously, the decay for echo is brief, that is, decay times of 0.51 seconds to 0.67 seconds and a pre-delay of 20 milliseconds Master Section/Compression:

Threshold: −10 dB

Ratio: 8:00:1

Attack: 0.46 milliseconds

Release: 560 milliseconds

Knee: 80

Master Section Level Adjustment (dB)

The level can be adjusted individually for the device and the environment, in which the method is to be used.

FIGS. 3 to 8 show audio video equipment (AV equipment), in which the method according to the invention is integrated. For this purpose, the AV equipment in each case has a signal processor, which is not shown in FIGS. 3 to 8 and on which software is located. The software contains an algorithm, which is processed by the signal processor in the form of an audio processor, wherein the algorithm covers the method according to the invention. It is a common feature of the AV equipment, shown in FIGS. 3 to 7, that, in addition to the sound input and sound output channels, it also has a picture input and picture output channels.

Figure 3A:
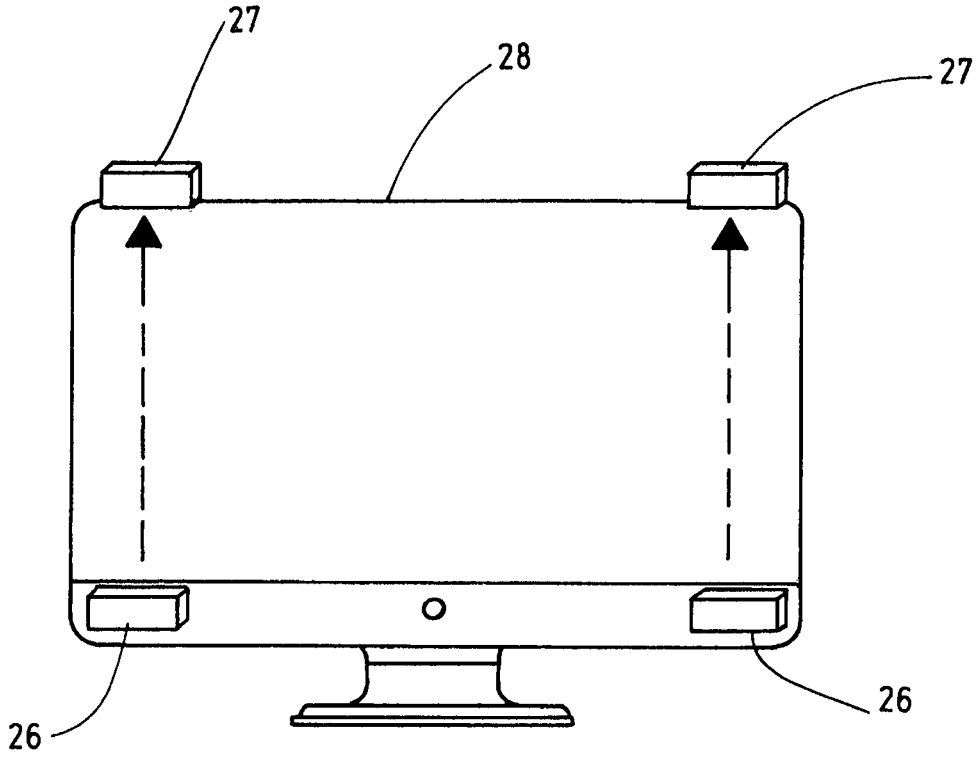
Figure 3B:
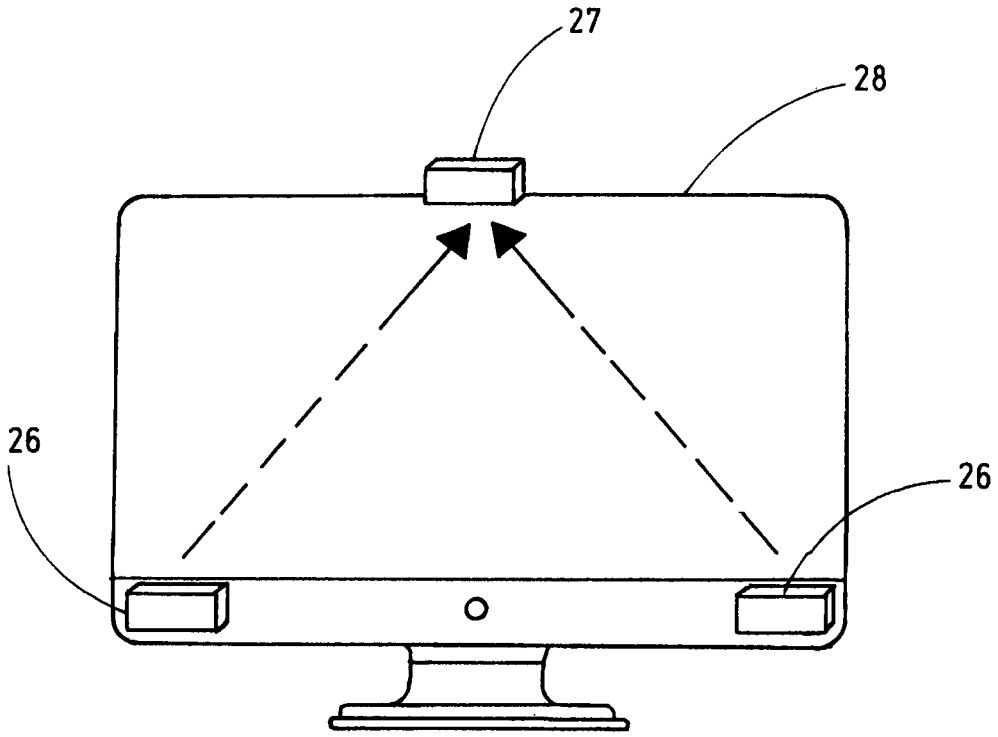
Figure 4A:
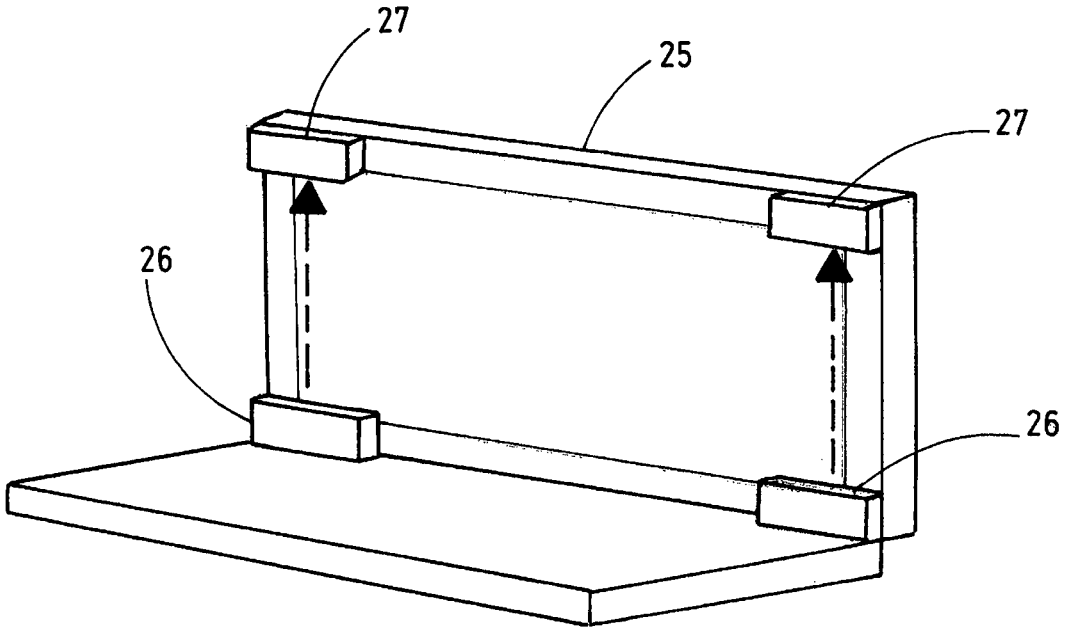
Figure 4B:
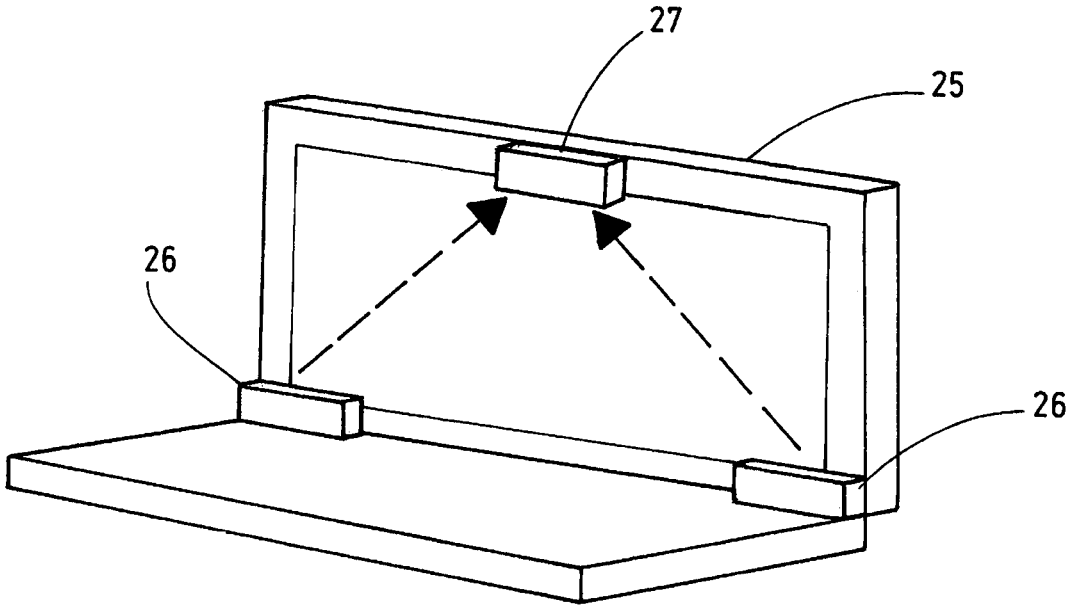
Figure 5A:
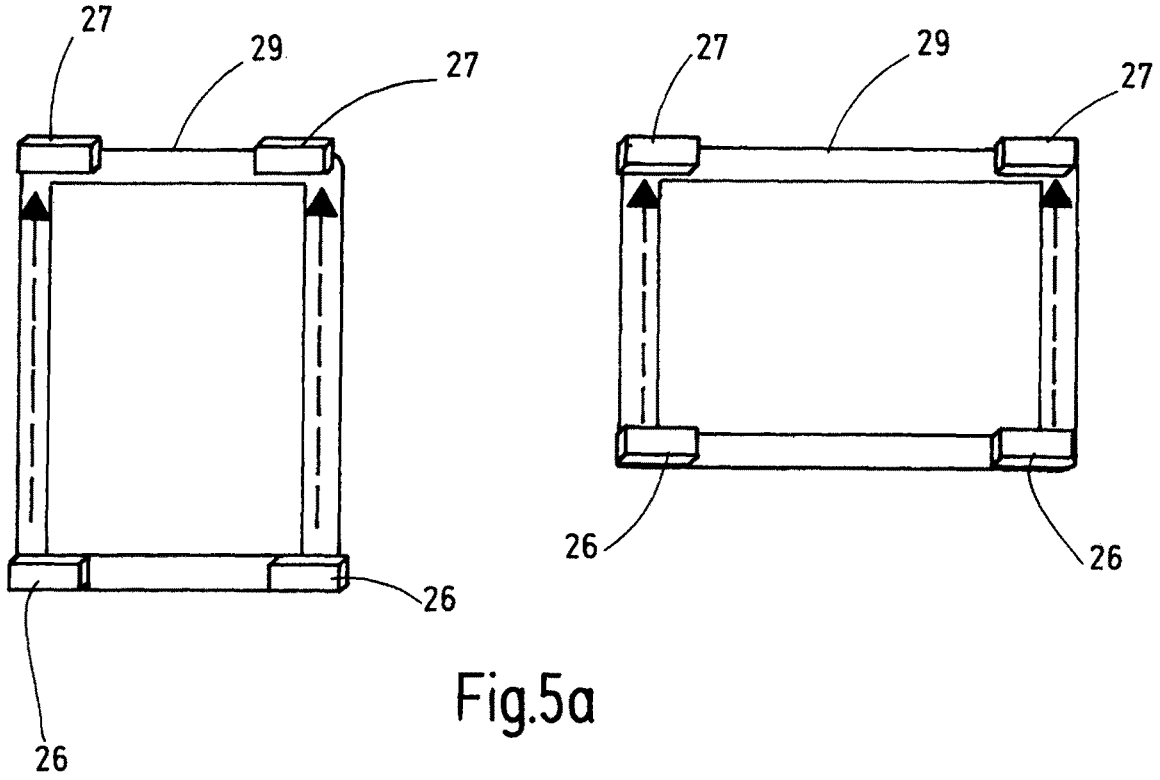
Figure 5B:
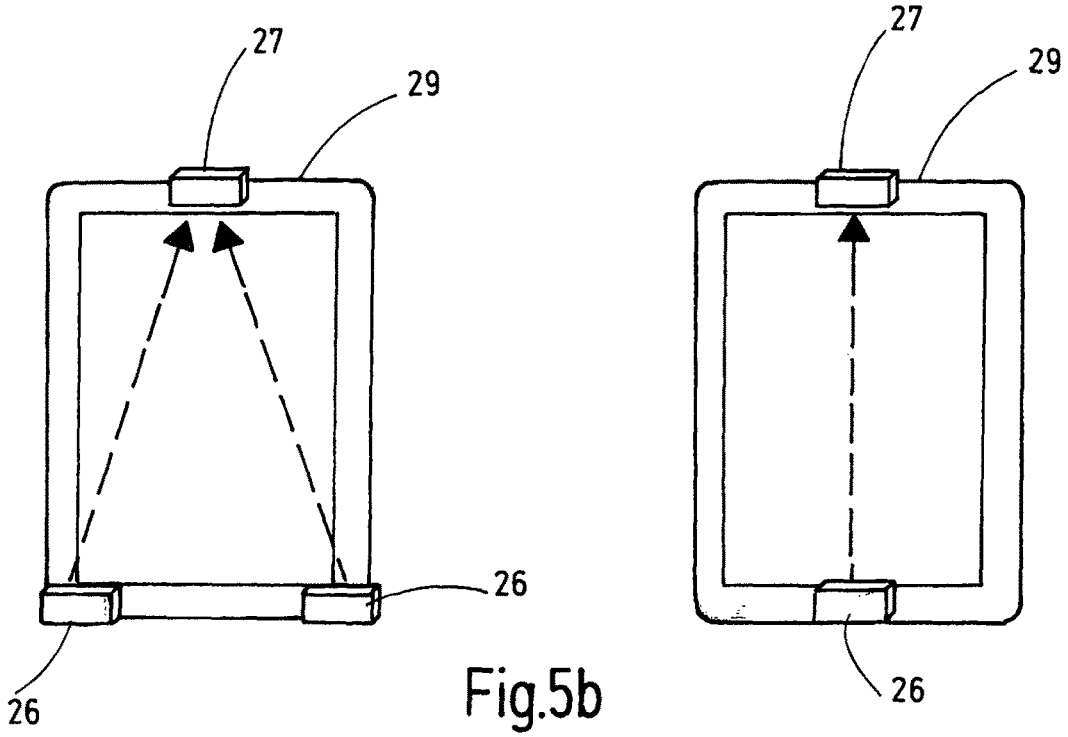

AV equipment, such as a television set (TV) and a flat screen set 28, shown in FIGS. 3*a*, 3*b*, have not only one or two loudspeakers for radiating mono and stereo sound, but three loudspeakers, 26, 27 for the mono sound (FIG. 3*b*) or four loudspeakers, 26, 27 for the stereo sound (FIG. 3*a*), since the upper listening level has been added. The upper listening level is extracted, as it were, from the lower listening level by the encoding described in FIG. 2. This is indicated by the dotted arrows in FIGS. 3 to 8. The loudspeakers, 26, 27 are installed in the conventional manner in accordance with the individual requirements of the equipment and mounted so that they make a coordinated audible range possible. It is also possible, for example, to let the loudspeakers of the upper listening level radiate upwards, in order to allow the audible range to become even more diffuse upwards.

Figure 8A:
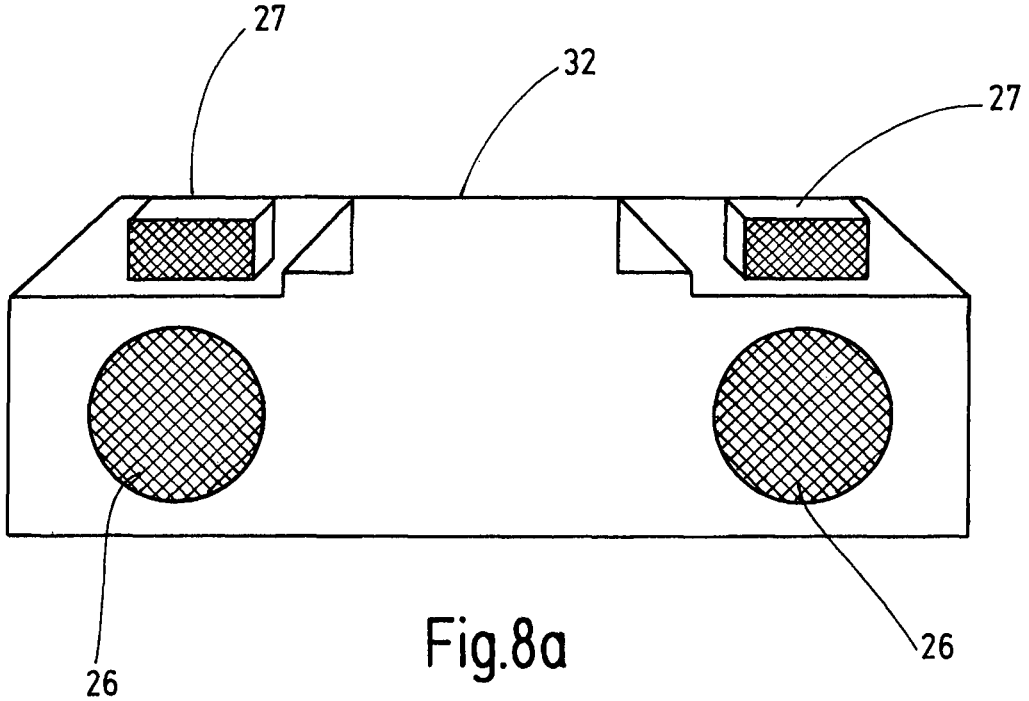
Figure 8B:
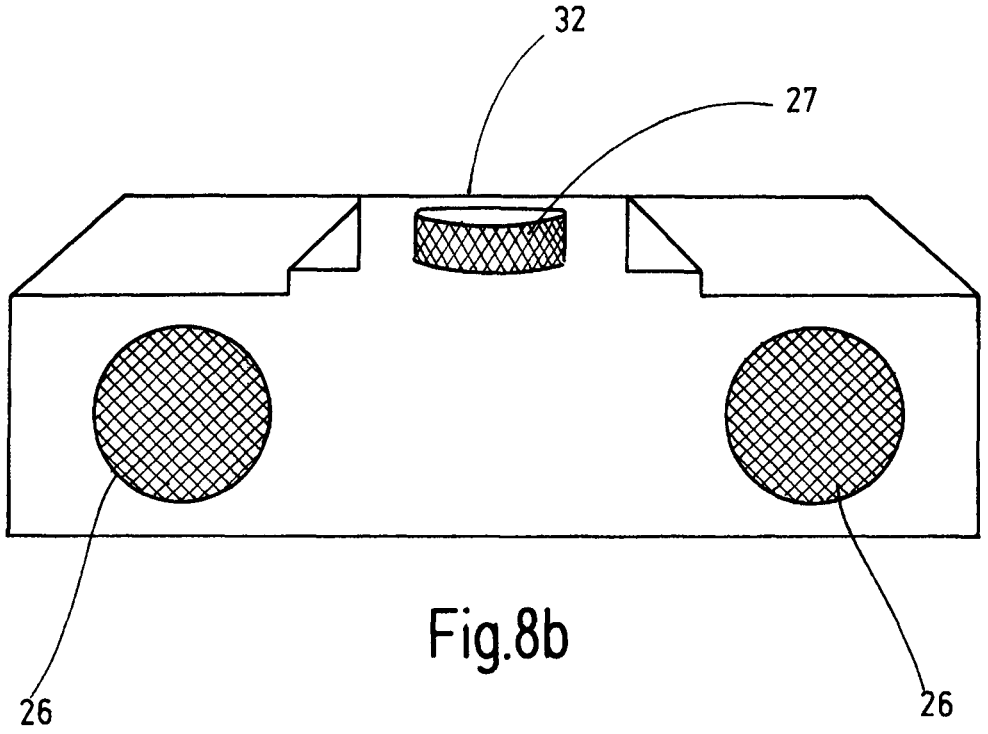

A mobile PC 25 (FIGS. 4*a*, 4*b*), a tablet PC 29 (FIGS. 5*a*, 5*b*) and a smart phone 31 (FIGS. 7*a*, 7*b*) represent further examples of the application in vertical use as well as in horizontal use, as does a radio 32 (FIG. 8*a*, 8*b*).

Figure 6A:
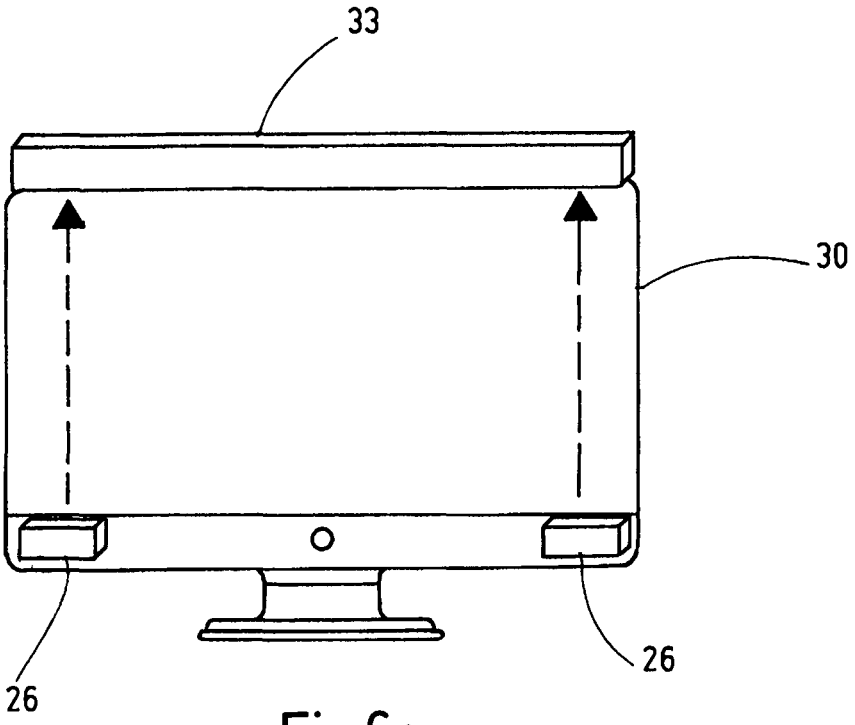
Figure 6B:
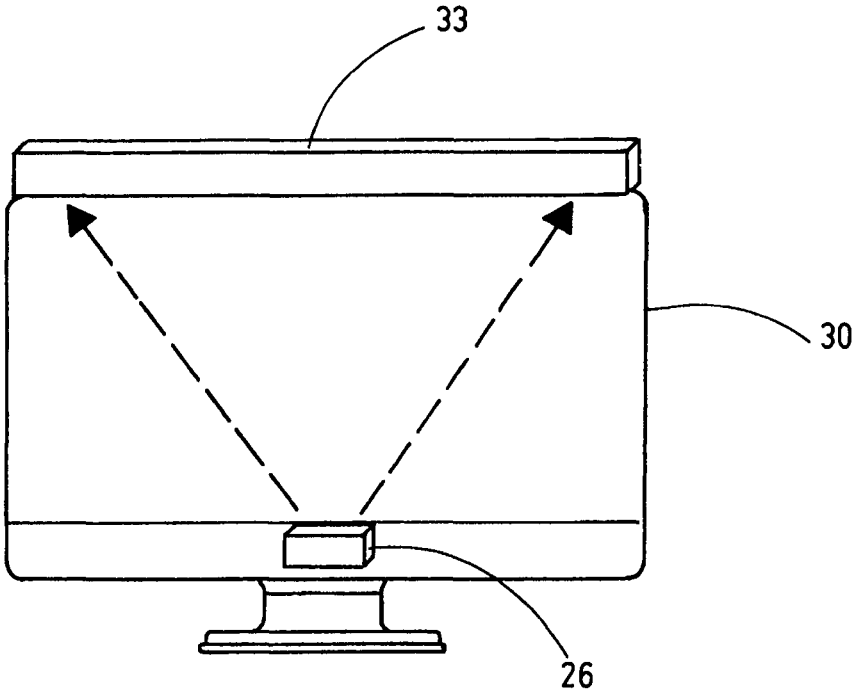
Figure 7A:
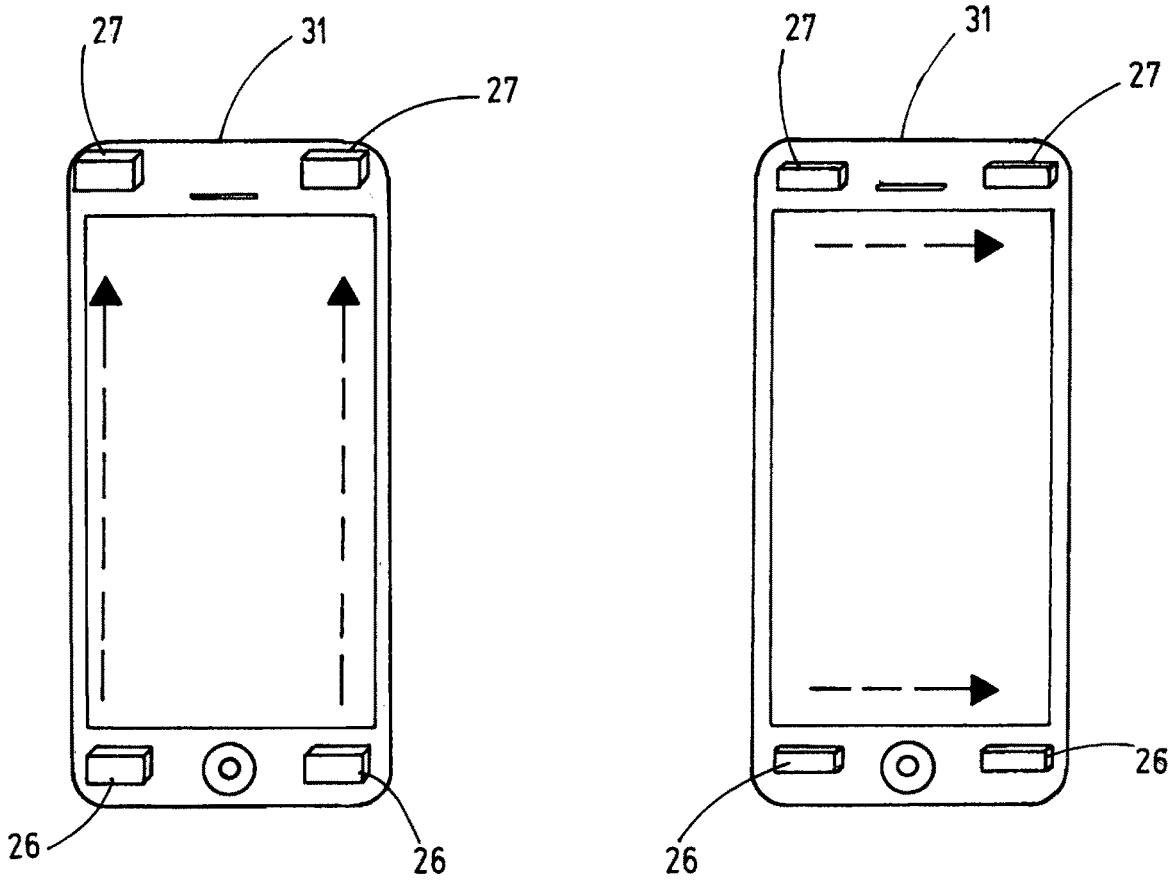
Figure 7B:
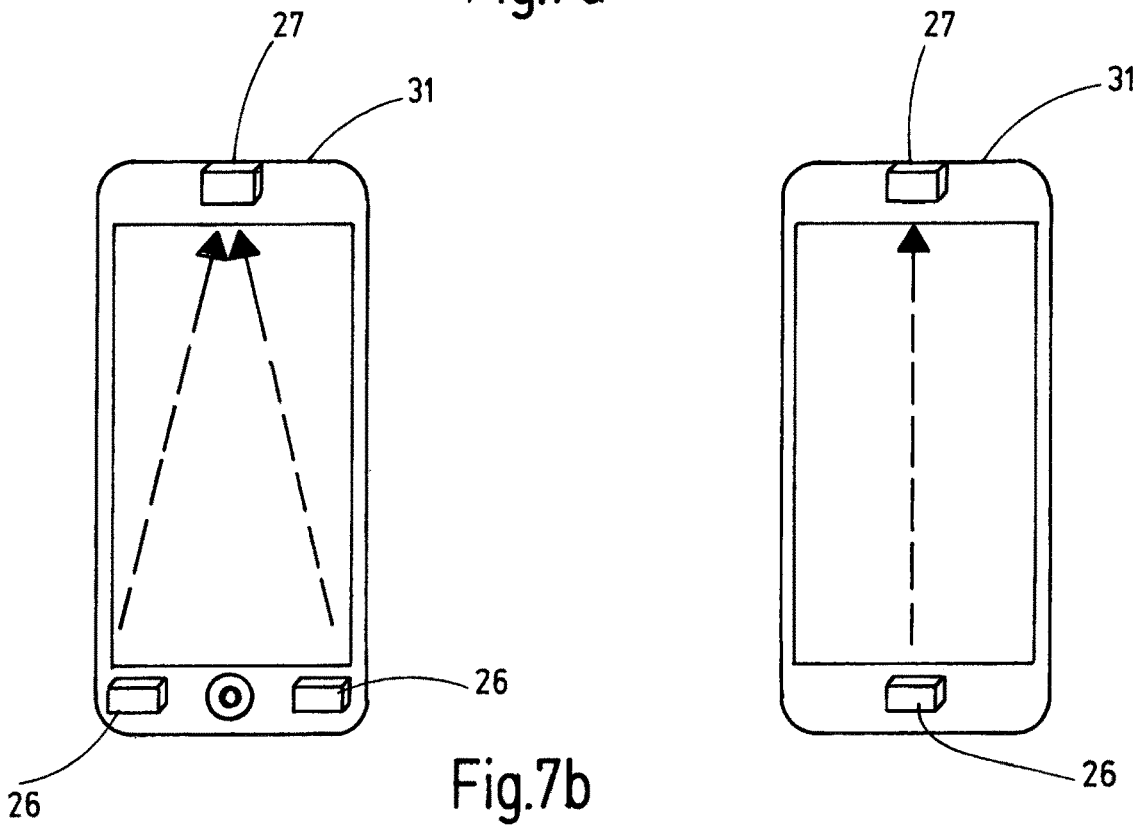

A sound bar 33 is also, as is evident from FIGS. 6*a*, 6*b*, not only used for the reproduction of the total sound of AV equipment, such as a television set, but also, in accordance with the invention, for radiating the extracted upper listening level. New loudspeaker constellations within these types of equipment arise from this since, for example, also a sound bar with individual outputs for the upper listening level according to the invention, supplies the loudspeakers of the TV set, which are no longer active for the operation of a sound bar, with the new signals of the upper listening level and the TV set can thus be operated more economically. Since a stereo signal is also generated within the scope of the invention, it can be combined in the AV equipment in turn with matrix surround sound decoders, in order to subject the sound of the upper listening level to a surround decoding. With that, it is possible to extract the whole of the upper listening level forwards and rearwards.

The embodiments of the present invention are not limited to the examples given above. Rather, a number of variations is conceivable, which make use of the solution shown also for embodiments of a different type. For example, the channels 8, 9 in the lower listening level 7 can also be processed further.

The inventive principle of the modular-like, expandable smallest unit of a signal generation, which leads to complex loudspeaker configurations, is also illustrated in FIG. 9.

Starting out from the two input channels R and L, the left output signal $L_{Hi}$ and the right output signal $R_{Hi}$ are generated in the lower listening level 7 and the upper listening level 6 by means of an algorithm in the signal processor 34, so that, to begin with, four output signals, two for the upper listening level 6 and two for the lower listening level 7, are generated.

As it is furthermore evident from FIG. 9, the left output signal $L_{Hi}$ and the right output signal $R_{Hi}$ are then added to a mono signal $L_{Hi}+R_{Hi}$ in the upper listening level 6 and supplied to a first loudspeaker 35.

The output signals R and L in the lower listening level 7 are then taken as channels $L_1$ and $R_1$ directly to the loudspeakers 36, 37 of the soundbar 40. At the same time, the output signals R and L serve as input signals R and L, in order to generate a lower listening level 7 and an upper listening level 6 once more within the scope of the method according to the invention. This takes place again by means of the algorithm in the signal processor 34, on which the software is located. The software contains an algorithm, which is processed by the signal processor.

Starting out from the splitting of the input signals R and L, the output signals R and L are generated in the lower listening level 7 and, in the upper listening level 6, the left output signal $L_{Hi}$ and the right output signal $R_{Hi}$ are generated, so that, once again, four output signals are generated, two for the upper listening level 6, that is, $L_{Hi}$ and $R_{Hi}$, and two for the lower listening level 7, that is, L and R. Subsequently, the signals $L_{Hi}$ and $R_{Hi}$ are mixed with the signals R and L in the lower listening level 7, that is, is added to the signal L and $R_{Hi}$ to the signal R. By these means, the added or mixed signals in the lower listening level are supplied to two further loudspeakers 38, 39 of the sound bar 40. Accordingly, the sound bar 40 has a total of five output channels, namely four output signals R, L, $L_{Hi}+L$, $R_{Hi}+R$ in the lower listening level 7 and one output signal $L_{Hi}+R_{Hi}$ in the upper listening level 6. All output channels can be processed further by the level control, the equalizer, the compressor etc.

The variation of a modular-like, expandable smallest unit, shown in FIG. 9, can be expanded in a sound bar by a subwoofer 41, as shown in FIG. 10. For this purpose, as shown in FIG. 10, the output signals R and L in the lower listening level, added in the signal sequence and before they are split again, can be sent to a low pass filter 42 and, at the same time, processed as R and L signals in the signal processor 34.

FIG. 11 also illustrates a further variation of the inventive principle of the modular-like, expandable smallest unit of a signal generation, which leads to complex loudspeaker configurations.

FIG. 11 shows the method according to the invention that the two input channels $R_{t1}$ and $L_{t1}$, which result from the summations R+C and L+C (C=center channel), generate the output signals $R_{1Hi}$ and $L_{1Hi}$ in the in the upper listening level 7 and the left output signal $L_1$ and the right output signal $R_1$ in the lower listening level 6, so that four output signals, two for the upper and two for the lower listening level, are generated. Here also, the signal processor 34 is used to generate the signals and, moreover, in the form of an audio processor, on which a software is located, which contains the algorithm.

The embodiment of the method according to the invention, shown in FIG. 11, differs from that described in FIG. 10 in that the generated output signals $R_{1Hi}$, $L_{1Hi}$, $L_1$ and $R_1$ are not used again as input signals, but that two further input signals $S_R$ and $S_L$, in the form of surround signals, are processed in parallel in the processor into output signals, which are decoded by a parallel processing into the output signals $R_{2Hi}$, $L_{2Hi}$, $L_2$ and $R_2$ in the upper and lower listening levels. The two output signals $L_1$, $L_2$ as well as the output signals $R_1$, $R_2$ are sent to the loudspeakers of the lower listening level 6, whereas the output signals $L_{1Hi}$, $R_{1Hi}$, $L_{2HI}$ and $R_{2Hi}$ of the upper listening level 7, as shown furthermore in FIG. 11, are summed up to the signals $R_{tHi}$, $L_{tHi}$ of the upper listening level 7, which are supplied to the loudspeakers of the upper listening level 7.

The further LFE channel is guided directly to its own outlet and, as LFE output channel, is supplied there to a further loudspeaker. This output channel, like all the other output channels, can also be processed further by a level control, equalizer, compressor, etc. The loudspeaker configuration of audio equipment, which corresponds to the embodiment described in connection with FIG. 11, is illustrated in FIG. 12.

It is a common feature of both the embodiments shown in FIGS. 10 and 11, that the method according to the invention is processed repeatedly in the signal processor 34.

LIST OF REFERENCE NUMERALS

2 room
3 listener
5 loudspeaker arrangement
4*a*, 4*b*, 6 upper listening level
5*a*, 5*b*, 7 lower listening level
8, 9 channels
10 signal detector
11 signal multiplier
12, 13, 21 delay
14, 19, 20 equalizer
15, 16 level control
17, 18 level control
22 compressor
23, 24 level control
25 PC
26, 27 loudspeaker
28 flat screen
29 PC
31 smart phone
32 radio
33 sound bar
34 signal processor
35, 36, 37 loudspeaker
38, 39 loudspeaker
sound bar
subwoofer
low pass filter

The invention claimed is:

1. A device with sound input and sound output channels, as well as a processor, wherein loudspeakers are assigned to the device, wherein a software is imported onto the processor, which contains an algorithm, which is processed by the processor, wherein the algorithm covering a method for audio reproduction in a multi-channel sound system comprising two input signals L and R, wherein output signals are generated for different listening levels, wherein the device comprises modules with a first unit and one or more additional units, wherein in the first unit of the device only one lower listening level and only one upper listening level are generated, wherein a maximum of six output signals, with a maximum of two output signals for the lower listening level and a maximum of four output signals for the upper listening level, are generated, and wherein the first unit of the device is expanded in modular fashion in that the output signals of the first unit serve as input signals one of the one or more additional units, in order to generate further lower and upper listening levels by the one or more additional units of the device.

2. The device according to claim 1, wherein the first unit and the additional units each have two input channels R and L, wherein in each of the first unit and the additional units a left output signal and a right output signal are generated in the lower listening level and the upper listening level by the algorithm in the signal processor so that four output signals, two for the upper listening level and two for the lower listening level are generated.

3. The device according to claim 2, wherein the left output signal and the right output signal are added to form a mono signal in the upper listening level and supplied to a first loudspeaker of the loudspeakers.

4. The device according to claim 2, further comprising a soundbar, wherein the output signals R and L in the lower listening level are taken as channels $L_1$ and $R_1$ directly to left and right loudspeakers of the soundbar, and wherein the output signals R and L serve as input signals R and L to one of the one or more additional units in order to generate a lower listening level and an upper listening level for the one of the one or more additional units by means of the algorithm in the signal processor on which the software is located.

5. The device according to claim 2 wherein in one of the additional units, wherein starting from a splitting of the input signals R and L, output signals R and L are generated in the lower listening level and, in the upper listening level a left output signal $L_{Hi}$ and a right output signal $R_{Hi}$ are generated, so that four output signals are generated, two for the upper listening level $L_{Hi}$ and $R_{Hi}$, and two for the lower listening level L and R.

6. The device according to claim 5, wherein the left output signal $L_{Hi}$ is mixed with the right input signal R and the right output signal $R_{Hi}$ is mixed with the left input signal L in the lower listening level.

7. The device according to claim 6, wherein the device comprises a soundbar 40 having a total of five output channels, namely four output signals R, L, $L_{Hi}$+L, $R_{Hi}$+R in the lower listening level and one output signal $L_{Hi}$+$R_{Hi}$ in the upper listening level, wherein the output signals R and L in the lower listening level are taken as channels $L_1$ and $R_1$ directly to left and right loudspeakers of the soundbar, and wherein the mixed signals in the lower listening level are supplied to two further loudspeakers of the soundbar.

8. The device according to claim 7, wherein the device further comprises a level control, an equalizer or a compressor, wherein the output channels are processed by the level control, the equalizer or the compressor.

9. The device according to claim 1, further comprising a subwoofer, and wherein the output signals R and L in the lower listening level, added in the signal sequence and before they are split again, are input to a low pass filter and, at the same time, processed as R and L signals in the signal processor.

10. The device according to claim 1, wherein two input channels $R_{t1}$ and $L_{t1}$, which result from summation of the right input channel R and a center channel, and from summation of the left input channel L and the center channel generate the output signals $R_{1Hi}$ and $L_{1Hi}$ in the upper listening level and the left output signal $L_1$ and the right output signal $R_1$ in the lower listening level, so that four output signals, two for the upper and two for the lower listening level, are generated.

11. The device according to claim 10, wherein the generated output signals $R_{1Hi}$, $L_{1Hi}$, $L_1$ and $R_1$ are not used again as input signals to one of the one or more additional modular units, wherein two further input signals SR and SL are surround signals, and are processed in parallel in the processor into output signals, which are decoded by a parallel processing into the output signals $R_{2Hi}$, $L_{2Hi}$, $L_2$ and $R_2$ in the upper and lower listening levels, and wherein the two output signals $L_1$, $L_2$ as well as the output signals $R_1$, $R_2$ are supplied to loudspeakers of the lower listening level, whereas the output signals $L_{1Hi}$, $R_{1Hi}$, $L_{2Hi}$ and $R_{2Hi}$ of the upper listening level are summed up to the signals $R_{tHi}$, $L_{tHi}$ of the upper listening level and are supplied to loudspeakers of the upper listening level.

* * * * *